US007192156B1

(12) United States Patent
Hung

(10) Patent No.: US 7,192,156 B1
(45) Date of Patent: Mar. 20, 2007

(54) WATERPROOF INDICATOR LIGHT

(76) Inventor: Chih-Wen Hung, Waipu No. 17-4, Waipu Village, Houlong Township, Miaoli County (TW)

( * ) Notice: Subject to any disclaimer, the term of this patent is extended or adjusted under 35 U.S.C. 154(b) by 0 days.

(21) Appl. No.: 11/356,854

(22) Filed: Feb. 21, 2006

(51) Int. Cl.
*F21L 4/02* (2006.01)

(52) U.S. Cl. ..... 362/158; 362/184; 362/196

(58) Field of Classification Search ..... 362/158, 362/184, 196, 242, 244, 251, 267, 800; 441/13, 441/16, 17, 18; 43/17.5
See application file for complete search history.

(56) References Cited

U.S. PATENT DOCUMENTS 6,086,218 A * 7/2000 Robertson ..... 362/184
6,776,502 B2 * 8/2004 Hung ..... 362/158
2004/0136186 A1 * 7/2004 Hsu ..... 362/208
2005/0056663 A1 * 3/2005 Yu ..... 362/96
2005/0057187 A1 * 3/2005 Catalano ..... 315/291

* cited by examiner

*Primary Examiner*—Y. My Quach-Lee
(74) *Attorney, Agent, or Firm*—Egbert Law Offices

(57) ABSTRACT

The present invention is a waterproof indicator light, which solves the problem that the length of the space needed for the battery is too long, caused by the battery needing to be in serial connection for the conventional waterproof indicator light. The invention includes a step-up apparatus in the illuminating module to reduce the number of batteries needed, or to change to a button mercury battery that has a lower voltage and is smaller. Then, the step-up apparatus is used to increase the voltage. By so doing, it largely reduces the space needed for the battery set, increases the length of the refracting surface for the illuminating module, and increases the illuminating effect as well.

4 Claims, 7 Drawing Sheets

WATERPROOF INDICATOR LIGHT

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a waterproof indicator light, and more particularly to an invention that has a step-up apparatus to reduce the voltage and space needed for the battery set.

BACKGROUND OF THE INVENTION

The indicator light disclosed in the present invention is a waterproof indicator light. As shown in FIGS. 1 and 3, there is a typical structure for conventional waterproof indicator light A. It is made of an upper and lower casings 10 20, and a hollow containment space 11 21 is formed inside the upper and lower casings 10 20 for the battery set 30. There is a conducting component 31 and illuminating module 32, and the assembling ends of the upper and lower casings 10 20 have male and female ends 12 22 for connection. With the combination of O-ring 13, the assembling parts of the upper and lower casings 10 20 become sealed. Because it is waterproof, the indicator light A is often uses as fishing lamp. This type of lamp can be used as a strobe light or for decoration. However, the structure of the conventional waterproof indicator light A mentioned above still has problems as follows.

1. So as to have sufficient voltage supply, the conventional waterproof indicator light A uses an LED light, which often needs 2 to 3 No. 5 batteries (1.5V), and all the batteries are connected in a serial connection. For these reasons, the length of one No. 5 battery is nearly 3 centimeters long, so when putting three No. 5 batteries in a serial connection, the waterproof indicator light must have room for 15 centimeters, which makes the length of the lower casing 20 for the battery set 30 overly long. This arrangement will create difficulty for the illuminating module 32 to bring out sufficient lighting through a thick lower casing 20 when it is illuminating.

2. When the conventional waterproof indicator light A is in the water, the over length of the lower casing 20 will cause the lamp to be effected by the water wave and bring out the optimal effect.

3. Because of the length of the lower casing 20 of the conventional waterproof indicator light is too long, it relatively shortens the length of the upper casing 10 that generates the primary light source, so that the entire length of the waterproof indicator light A would not be too long, except, this obviously reduces its illuminating effect, and misses the point.

Thus, to overcome the aforementioned problems of the prior art, it would be an advancement in the art to provide an improved structure that can significantly improve the efficacy.

To this end, the inventor has provided the present invention of practicability after deliberate design and evaluation based on years of experience in the production, development and design of related products.

BRIEF SUMMARY OF THE INVENTION

The waterproof indicator light disclosed in the present invention B primarily uses the core invention of a step-up apparatus 90 in the illuminating module 60 to reduce the numbers of the battery, or uses button-type mercury battery that is smaller (the type of battery set 70 disclosed in FIG. 4, 6). Then the step-up apparatus 90 is used to increase the voltage to a sufficient amount; and by so doing, it reduces the space needed for the battery set 70 (note: the thickness of the button-type mercury battery is about ⅓ of No. 5 battery). The size and length of the indicator light B reduces relatively as well, which improves the issue with the lower casing being too long and easy to move when it is in the water. The length of the lower casing 50 reduces, which increases the length of the refracting surface of the upper casing 40, and increases and brightens the luminous surface.

The waterproof indicator light B of the present invention illuminates because the length of the lower casing 50 of the battery set 70 largely reduces, during the upper casing 40. The light can be easily guided to the bottom of the lower casing 50 and can make the bottom of the waterproof indicator light B have a better illuminating effect.

There is a new effect generated by the present invention. The present invention has another feature of resistor 63 in the luminous body 62 for the illuminating module 60, which responds to the feature of the step up apparatus and increases the battery set 70 to a predetermined voltage, except the luminous body uses different resistor. Because of the color of lighting, it can be solved by placing the resistor 63 mentioned above to ensure the normal operation and life of the luminous body 62.

In addition, the technical point that adding step-up apparatus 90 in the illuminating module 60 can also be applied to the conventional waterproof indicator light disclosed in FIGS. 1 and 2 (which shows the upper casing short, and lower casing long), and by so doing to increase the voltage of the battery in serial connection to generate more bright LED, and to increase the illuminating effect.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
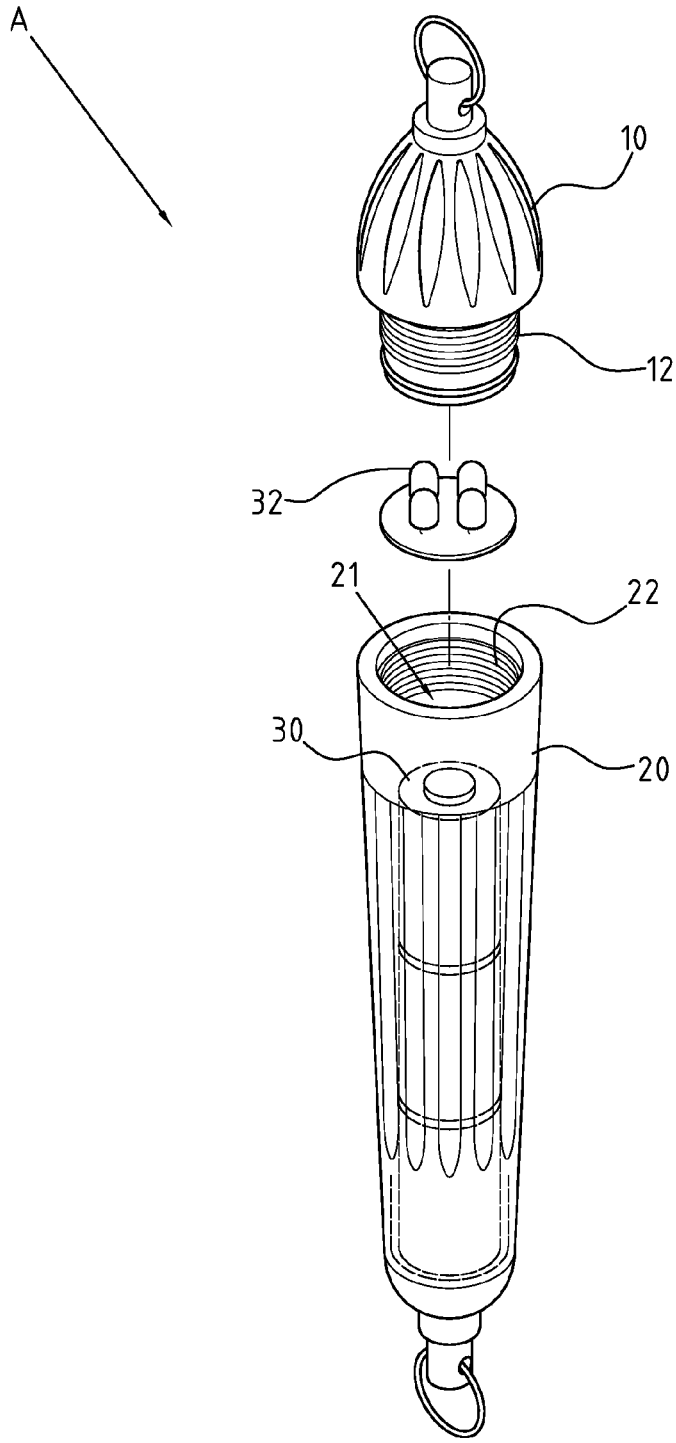
FIG.1 PRIOR ART
FIG. 1 shows the disassembled, perspective view of the conventional structure.

The features and the advantages of the present invention will be more readily understood upon a thoughtful deliberation of the following detailed description of a preferred embodiment of the present invention with reference to the accompanying drawings.

As shown in FIGS. 3, 4, 5 and 6, there is a preferred embodiment of the improve structure of the waterproof indicator light of the present invention. This embodiment is for description only; thus, it is not limited to this structure when applying the patent. The waterproof indicator light B mentioned herein comprises the following elements.

The invention includes an upper casing 40, which can be illuminated. A refracting surface 41 is designed at the pre-determined area outside the upper casing 40, and a hollow containment space 42 is formed inside. The bottom of the upper casing 40 has an assembly part 43, and the assembly part 43 of the embodiment has female screw design.

The invention also includes a lower casing 50, which can also be illuminated. A hollow containment space 51 is formed inside the lower casing 50, and an assembling part 52 is placed on the top. The assembly part 52 of the present invention has male screw designs, and the assembly part 52 of the lower casing 50 can be connected to the assembly part 43 of the upper casing 40 by the combination of a sealing ring 53, keeping the water from coming into the assembly part.

An illuminating module 60 comprises a circuit board 61 and pre-determined number of luminous bodies 62. The luminous body 62 of the embodiment is an LED (Light Emitting Diode). The illuminating module 60 can be placed between the assembly parts 43 52 of the upper and lower casings 40 50.

A battery set 70 is placed inside the hollow containment space 51 of the lower casing 50, and provides the power needed for illuminating module 60.

A conductive component 80 generates electrical connection between the battery set 70 and illuminating module 60. The conductive component 80 of the embodiment is made of a bent conductive metal wire, and a C-shaped circuit board connecting point 81 is formed on top. A battery connecting point 82 is formed at its bottom.

A step-up apparatus 90 is placed on the pre-determined location on the circuit board 61 of the illuminating module 60, and it increases the output voltage of the battery set 70 to the pre-determined high voltage value. This step up apparatus 90 mentioned herein exists in the electrical components, and its function is to control the battery input voltage and to increase the user's desired voltage therethrough. In terms of the current technology, it increases the 1.5 volt battery to 7.5 volt (equals to five times), therefore, it is quite suitable for the electrical structure for an LED, which uses lower voltage and generates a high degree of brightness.

Based on this advantage, the present invention applies this step up apparatus to the structure of the waterproof indicator light B to reduce the voltage needed for its battery set 70, or to generate more functions for luminous body 62.

Figure 4:
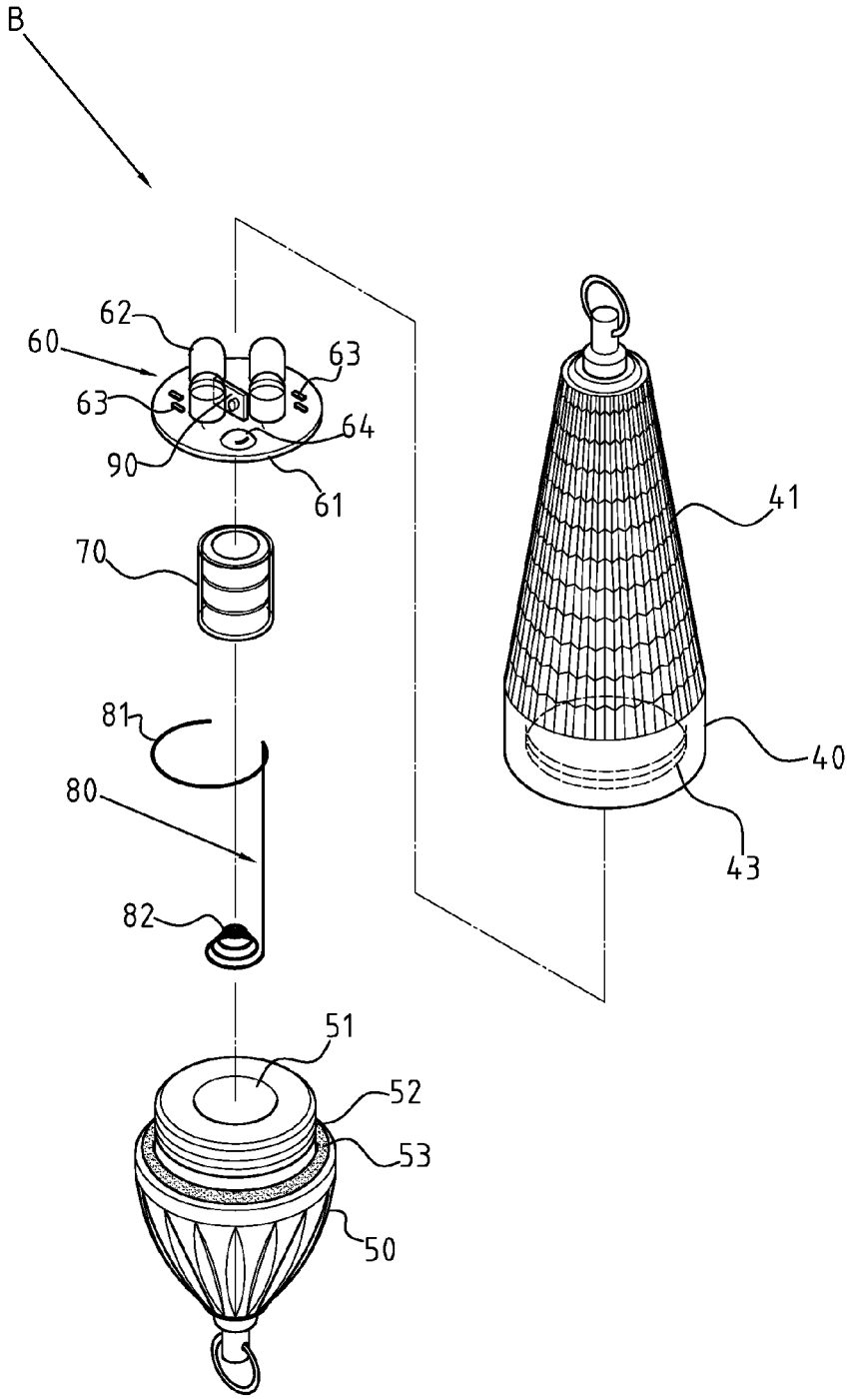
FIG. 4 shows the exploded, perspective view of the present invention.
Figure 5:
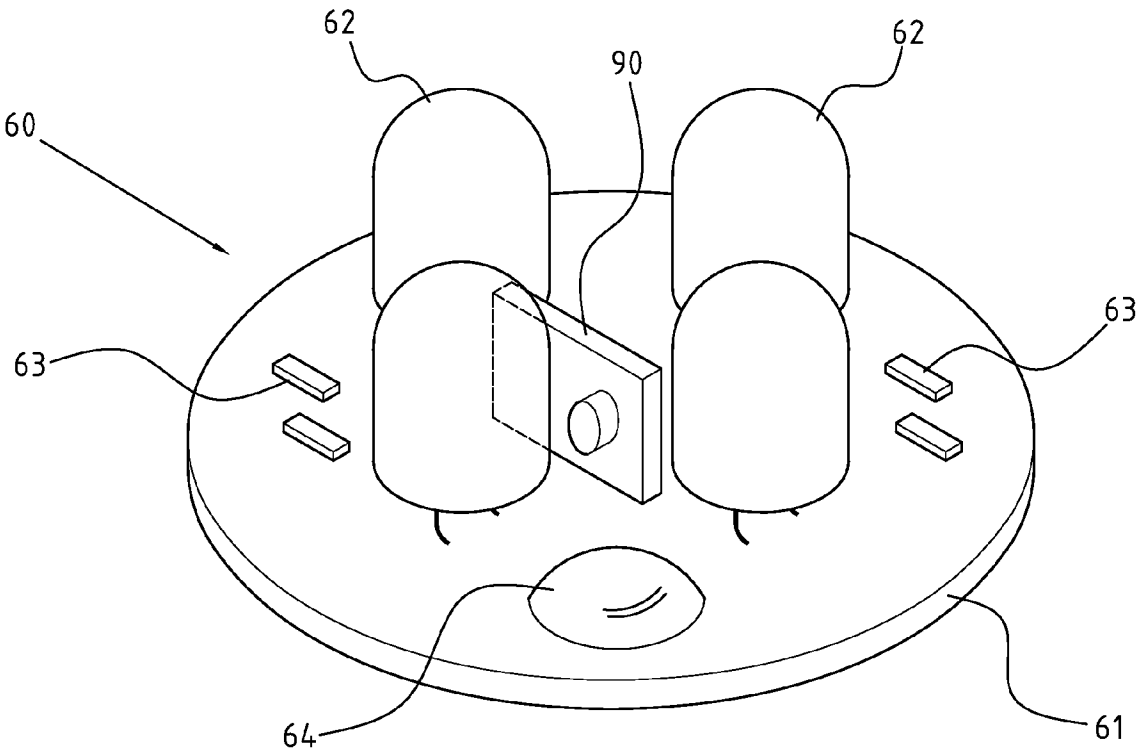
FIG. 5 shows the enlarged, perspective view of illuminating module of the present invention.
Figure 6:
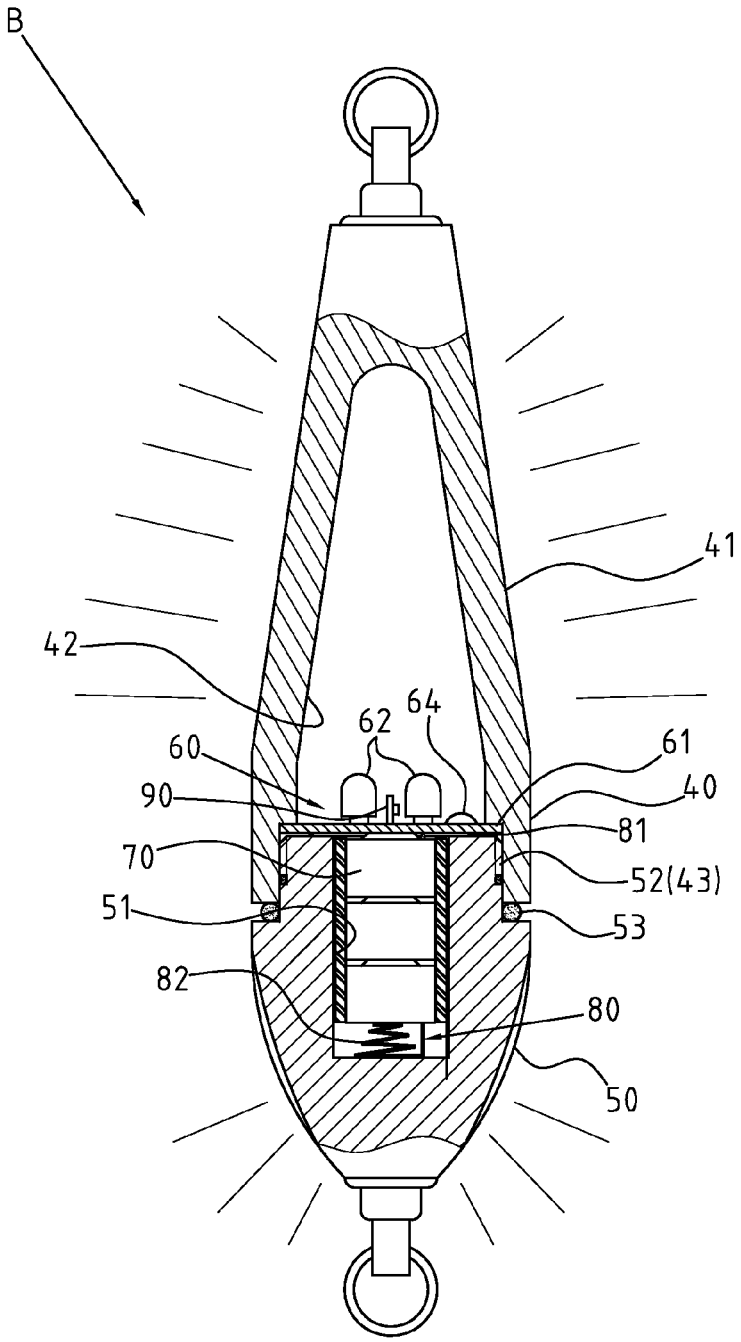
FIG. 6 shows the assembled, cross-sectional view of the present invention.

The battery set 70 shown in FIGS. 4 and 6 has three button-type mercury batteries. The voltage for one mercury battery is 1.3 volt; therefore, the total voltage for all three would be 3.9 volt, which is lower than the total voltage, 4.5 volt, of the conventional batteries. However, by setting up the step up apparatus mentioned above, it can increase the voltage tremendously, and reduce electrical consumption.

A resistor 63 may be placed on the circuit board 61 of the illuminating module 60. When the step-up apparatus 90 increases the voltage of the battery set 70 to the pre-determined high voltage, it outputs to all luminous bodies 62 with the same voltage. However, all luminous bodies 62 apply to different voltages because different lighting (note: the difference in lighting may be caused by the quality of the fuses and painting material). Because of this reason, the luminous body that has a lower voltage can be solved by using the resistor 63 mentioned before to ensure the normal operation of the luminous body 62 and life spin.

Among them, a flash-controlled IC 64 can be placed on the circuit board 61 of the illuminating module 60 to control the flashing module of the luminous body 62 (such as flashing time).

Through the above structure and design, the operation of the present invention is explained as follows.

Figure 2:
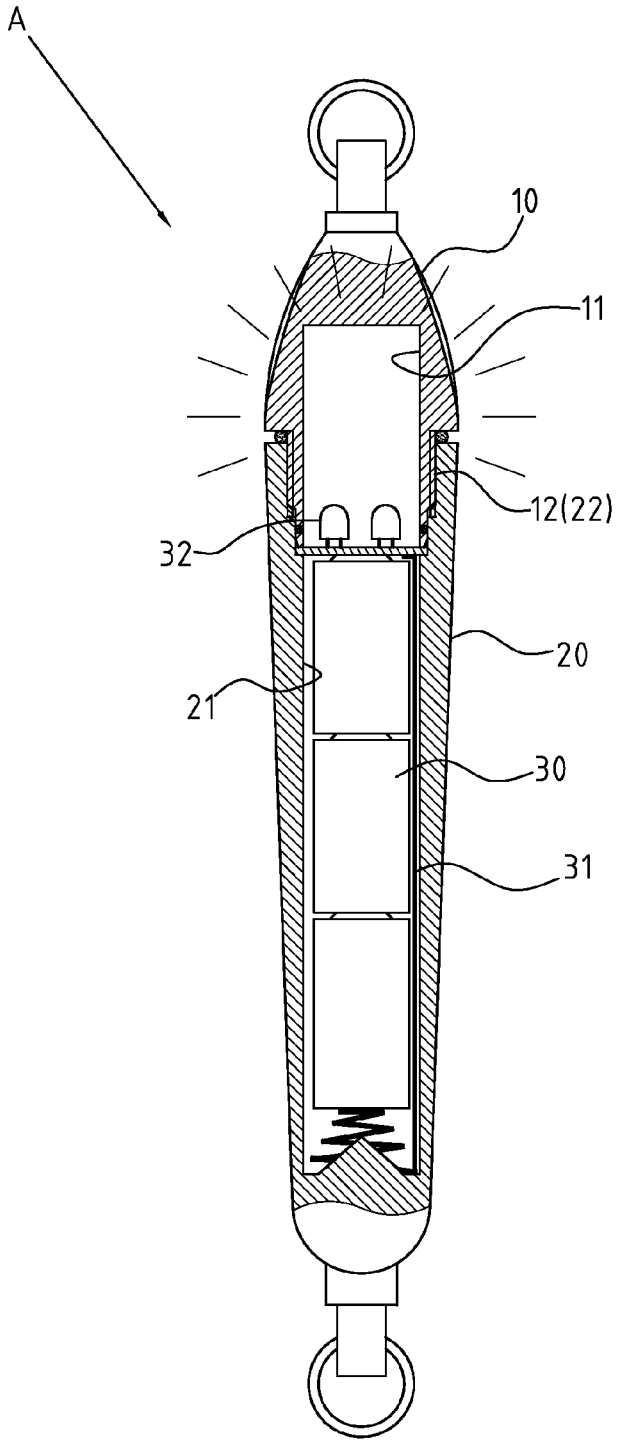
FIG.2 PRIOR ART
FIG. 2 shows the assembled, cross-sectional view of the conventional structure.
Figure 3:
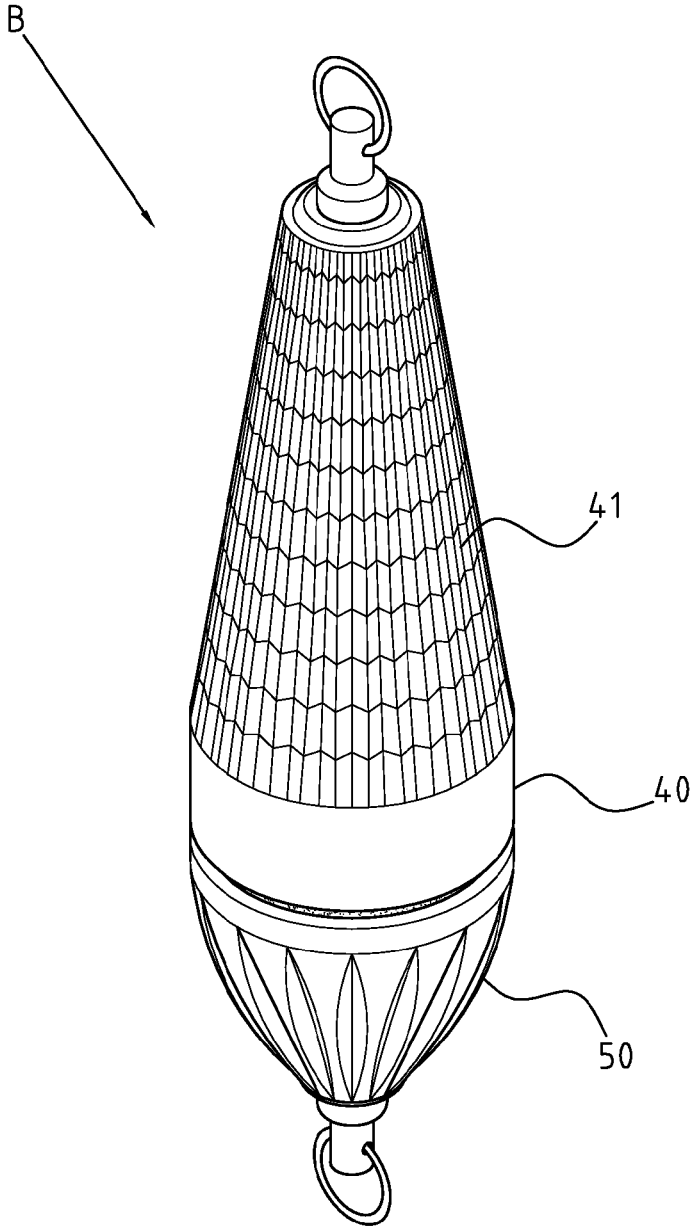
FIG. 3 shows the assembled, perspective view of the present invention.
Figure 7:
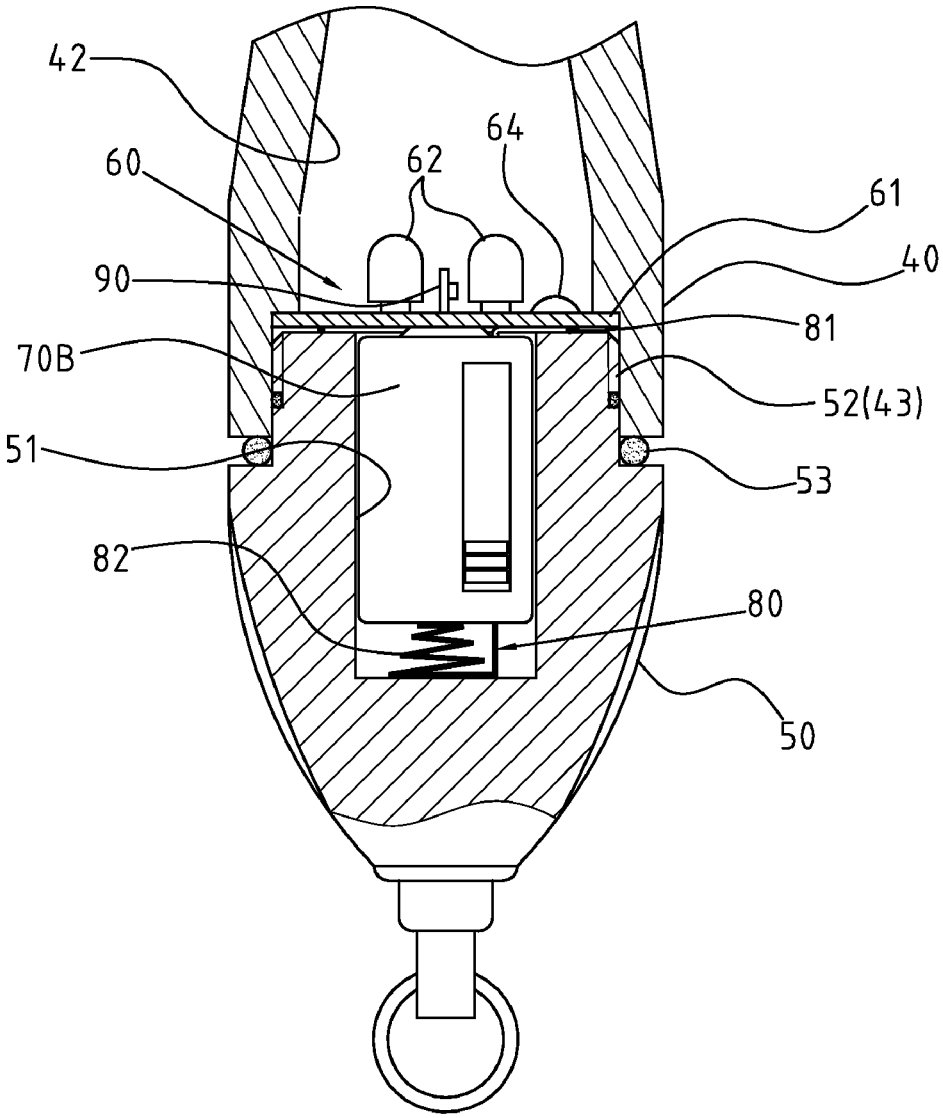
FIG. 7 shows a cross-sectional view of the battery set of the present invention can be embodiment of a battery.

There is a part where the luminous body 62 of the waterproof indicator light B is the same as the conventional structure. Therefore, the operation is briefly explained here. As shown in FIG. 6, when the user tightens the assembly parts 43 52 of the upper and lower casings 40 50, it makes the connecting end 81 of the circuit board of the conductive component 80 and the electrode at the top of the battery set 70 close tightly to the electrode at the bottom of the circuit board 61 of the illuminating module 60, which connects the positive and negative ends of the circuit board 61 and the battery set 70. By so doing, the luminous body 62 is lit up, and the INTERNATIONAL CLASS (flash-controlled INTERNATIONAL CLASS) 64 is used on the circuit board 61 to control the flashing module of the luminous body 62. On the other hand, when the assembly parts 43 52 of the upper and lower casings 40 50 are closed tightly, it also presses sealing ring 53 to keep the water from coming into the hollow containment space 42 51 of the waterproof indicator light B. Also, the waterproof indicator light B disclosed herein has a step-up apparatus 90 installed in the illuminating module 60, which can also shorten the consumption of the battery set. The battery set 70B shown in FIG. 7 can be a single battery, which is two batteries less than the conventional structure disclosed in the FIG. 2. However, it can use the feature of the step up apparatus 90 to increase the output voltage, and further reduce electrical consumption.

I claim:

1. A waterproof indicator light comprising:

an upper casing formed of a light-transmissive material, said upper casing having a light refracting surface on an exterior thereof, said upper casing having a hollow containment space therein, said upper surface having a connector at a bottom thereof;

a lower casing formed of a light-transmissive material, said lower casing defining a hollow containment space therein, said lower casing having a connector at a top thereof engaged with said connector of said upper casing, said connector of said lower casing having a sealing ring therearound so as to form a liquid-tight seal between said upper and lower casings;

an illuminating module having a circuit board and a plurality of light-emitting diodes, said illuminating module positioned at a juncture of said upper and lower casings;

a plurality of disc-shaped batteries positioned in said hollow containment space of said lower casing; said plurality of disc-shaped batteries selectively connected to said illuminating module so as to provide power to said plurality of light-emitting diodes;

a conductive component extending in said hollow containment space of said lower casing, said conductive component having an upper C-shaped member in planar contact with and electrical connection with said circuit board and a lower connection point, said lower connection point being in contact with a terminal of one of said plurality of batteries, said conductive component having a conductor extending between said lower connection point and said C-shaped member; and a step-up means positioned on said circuit board, said step-up means for increasing on output voltage of said plurality of disc-shaped batteries to a pre-determined value.

2. The waterproof indicator light of claim 1, said connector of said upper casing being a female threaded connector, said connector of said lower casing being a male threaded connector.

3. The waterproof indicator light of claim 1, said illuminating module having a resistor thereon.

4. The waterproof indicator light of claim 1, further comprising:

a flash controlling means affixed to said circuit board of said illuminating module, said flash controlling means for controlling a flashing of said plurality of light-emitting diodes.

* * * * *